US007676167B2

(12) United States Patent
Yoshioka et al.

(10) Patent No.: US 7,676,167 B2
(45) Date of Patent: Mar. 9, 2010

(54) APPARATUS AND METHOD FOR FORMING AN IMAGE WITH VARIABLE PROCESSING SPEED OR VARIABLE DEVELOPER MIXING SPEED

(75) Inventors: Tohru Yoshioka, Kitakatsuragi-gun (JP); Shuichi Morikuni, Nara (JP); Syohji Tomita, Yao (JP); Masatsugu Nakamura, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 367 days.

(21) Appl. No.: 11/783,488

(22) Filed: Apr. 10, 2007

(65) Prior Publication Data

US 2007/0237535 A1 Oct. 11, 2007

(30) Foreign Application Priority Data

Apr. 11, 2006 (JP) ..... 2006-108752

(51) Int. Cl.
*G03G 15/08* (2006.01)
*G03G 15/00* (2006.01)

(52) U.S. Cl. ..... 399/53; 399/43; 399/44; 399/254

(58) Field of Classification Search ..... 399/53, 399/254, 255, 258, 262, 263, 43, 44
See application file for complete search history.

(56) References Cited

U.S. PATENT DOCUMENTS 6,785,481 B2 * 8/2004 Bray et al. ..... 399/49

FOREIGN PATENT DOCUMENTS

| | | |
|---|---|---|
| JP | 02-084676 | 3/1990 |
| JP | 6-148995 | 5/1994 |
| JP | 07-121018 | 5/1995 |
| JP | 2001-201897 A | 7/2001 |
| JP | 2003-50497 A | 2/2003 |
| JP | 2006-235271 | 9/2006 |

* cited by examiner

*Primary Examiner*—Hoang Ngo
(74) *Attorney, Agent, or Firm*—Nixon & Vanderhye, PC

(57) ABSTRACT

An apparatus for forming an image according to the present invention includes a coverage rate finder, a developing unit, and a control unit. The coverage rate finder finds the coverage rate of the image. The developing unit holds developer in it and includes a stirring means for stirring the held developer at a stirring speed. The developing unit supplies the stirred developer to a surface of an image carrier. When the apparatus forms the image consecutively on sheets of paper, the control unit changes the stirring speed in proportion to the coverage rate. When the apparatus forms an image with a higher coverage rate consecutively on sheets of paper, the control unit makes the stirring speed higher.

16 Claims, 7 Drawing Sheets

FIG.3

| COVERAGE RATE | AMOUNT OF TONER FOR EACH SHEET (G) | DETERMINATION | | |
|---|---|---|---|---|
| | | PRINTING SPEED (CIRCUMFERENTIAL VELOCITY OF DRUM) | | |
| | | 355MM/S | 173MM/S | 124MM/S |
| 20 % | 10 | ○ | ○ | ○ |
| 50 % | 24 | ○ | ○ | ○ |
| 60 % | 29 | × | ○ | ○ |
| 70 % | 34 | × | ○ | ○ |
| 80 % | 39 | × | × | ○ |

FIG.7

| COVERAGE RATE | AMOUNT OF TONER FOR EACH SHEET (G) ENVIRONMENTAL RATE ENVIRONMENTAL CONDITION | | | DETERMINATION | | |
|---|---|---|---|---|---|---|
| | 1.00 | 1.24 | 0.92 | CIRCUMFERENTIAL VELOCITY OF DRUM | | |
| | NN | HH | LL | 355MM/S | 173MM/S | 124MM/S |
| 20 % | 10 | | | ○ | ○ | ○ |
| 50 % | 24 | | | ○ | ○ | ○ |
| 60 % | 29 | | | × | ○ | ○ |
| 70 % | 34 | | | × | ○ | ○ |
| 80 % | 39 | | | × | × | ○ |
| 20 % | | 12 | | ○ | ○ | ○ |
| 50 % | | 30 | | × | ○ | ○ |
| 60 % | | 36 | | × | ○ | ○ |
| 70 % | | 42 | | × | × | ○ |
| 80 % | | 48 | | × | × | × |
| 20 % | | | 9 | ○ | ○ | ○ |
| 50 % | | | 22 | ○ | ○ | ○ |
| 60 % | | | 27 | × | ○ | ○ |
| 70 % | | | 31 | × | ○ | ○ |
| 80 % | | | 36 | × | ○ | ○ |

APPARATUS AND METHOD FOR FORMING AN IMAGE WITH VARIABLE PROCESSING SPEED OR VARIABLE DEVELOPER MIXING SPEED

CROSS REFERENCE

This Nonprovisional application claims priority under 35 U.S.C. §119(a) on Patent Application No. 2006-108752 filed in Japan on Apr. 11, 2006, the entire contents of which are hereby incorporated by reference.

BACKGROUND OF THE TECHNOLOGY

The present technology relates to an image forming apparatus including a developing unit that supplies developer so as to develop an electrostatic latent image based on image information. This technology also relates to an image forming method including the step of supplying developer from a developing unit so as to develop an electrostatic latent image based on image information.

Some electrophotographically image-forming apparatus such as copying machines and printers use two-component developer, which consists of carrier and toner.

An image forming apparatus using two-component developer includes a photoreceptor drum and a developing unit, which includes a developing sleeve fitted with a magnet in it. The developing unit stirs and mixes the carrier and toner of the developer in it, so that the toner is charged electrostatically. The charged toner sticks to the particles of the carrier, which are then attracted magnetically to the circumferential surface of the developing sleeve. A magnetic brush consisting of carrier and toner is formed on the sleeve surface. The rotation of the developing sleeve moves the carrier and the toner out of the developing unit to the position where the magnetic brush is close to or in contact with the circumferential surface of the photoreceptor drum on which an electrostatic latent image has been formed. This causes the toner in the magnetic brush to be attracted electrostatically to the latent image, so that a toner image is developed on the drum surface.

When the apparatus forms an image with a high coverage rate consecutively on sheets of paper, the apparatus consumes a large amount of toner, so that toner needs to be supplied to the developing unit. Immediately after toner is supplied to the developing unit, the toner is not yet charged electrically. This makes it necessary to stir the supplied toner before the toner is supplied to the photoreceptor drum.

Therefore, the apparatus needs to interrupt its image forming operation so that toner can be supplied to the developing unit and stirred.

Immediately after toner is supplied to the developing unit, the toner and the carrier are stirred and mixed insufficiently. Accordingly, even though the image forming operation is restarted soon after toner is supplied to the developing unit and stirred, a large part of the toner is charged insufficiently, so that the formed image is low in quality. This makes a difference in image quality between the sheets on which the image is formed before and after the image forming operation is interrupted.

In particular, because recent image forming apparatus form images at high speed, the foregoing problem arises remarkably. There are demands for image forming apparatus that can keep forming images at high speed without lowering the quality of the images and interrupting the image forming operation.

For example, JP-H07-121018A discloses a recent image forming apparatus, which includes a developing unit fitted with a sensor for sensing the toner concentration in the unit. Until the sensed concentration reaches a predetermined value after toner starts to be supplied to the developing unit, the amount of toner supplied per unit time to the unit is smaller than when the apparatus is in a steady state. This prevents the amount of toner in the developing unit from increasing in comparison with the amount of carrier in this unit suddenly after toner starts to be supplied to the unit. The sudden increase would vary the toner concentration in the two-component developer.

As stated above, until the toner concentration reaches the predetermined value after toner starts to be supplied to the developing unit, the amount of toner supplied per unit time to the unit is smaller than when the apparatus is in its steady state. As a result, when the apparatus forms an image with a high coverage rate consecutively on sheets of paper, the apparatus needs to interrupt its image forming operation so that toner can be supplied in time to the developing unit. The smaller amount of toner supplied to the developing unit makes the interrupting time longer, so that it is impossible to form the image at a higher speed.

The object of the present technology is to provide an apparatus and a method that can form an image with a high coverage rate consecutively on sheets of paper at a high speed without lowering the quality of the image and interrupting the image forming operation of the apparatus.

SUMMARY OF THE TECHNOLOGY

An apparatus for forming an image includes a coverage rate finder, a developing unit, and a control unit. The coverage rate finder finds the coverage rate of the image. The developing unit holds developer in it and includes a stirring means for stirring the held developer at a stirring speed. The developing unit supplies the stirred developer to a surface of an image carrier. When the apparatus forms the image consecutively on sheets of paper, the control unit changes the stirring speed in proportion to the coverage rate. When the apparatus forms an image with a higher coverage rate consecutively on sheets of paper, the control unit makes the stirring speed higher.

BRIEF DESCRIPTION OF THE DRAWINGS

FIG. 3 is a table showing the relations between coverage rates and circumferential velocities of the photoreceptor drum.

FIG. 7 is a table showing the relations between coverage rates and circumferential velocities of the photoreceptor drum of the third embodiment.

DETAILED DESCRIPTION OF THE TECHNOLOGY

Preferred embodiments will be described below with reference to the accompanying drawings.

Figure 1:
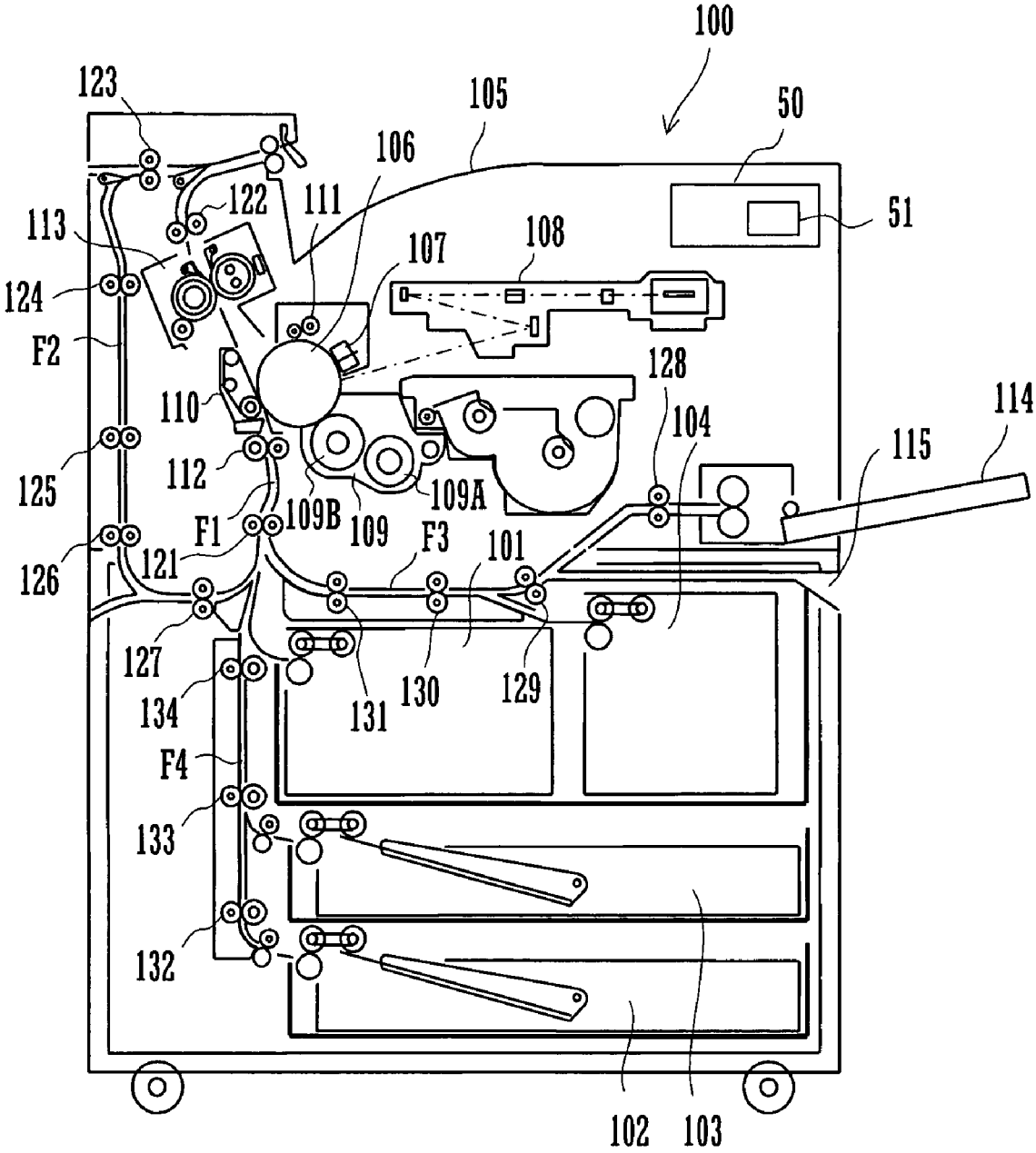
FIG. 1 is a schematic sectional view of an image forming apparatus according to a first embodiment and a second embodiment.

FIG. 1 is a schematic sectional view of an image forming apparatus 100 according to a first embodiment and a second embodiment.

First Embodiment

The apparatus 100 forms an image on a sheet of paper by an electrophotographic process. Feed cassettes 101-104 are fitted in a lower portion of the apparatus 100. A discharge tray 105 is fitted at the top of the apparatus 100. A conveying path F1 extends between the feed cassette 101 and the discharge tray 105. A photoreceptor drum 106, which corresponds with the image carrier, is supported near the conveying path F1. A charger 107, an optical scanning unit 108, a developing unit 109, a transfer unit 110, and a cleaning unit 111 are fitted around the photoreceptor drum 106.

Paper stop rollers 112 are supported on the conveying path F1 and positioned upstream from the photoreceptor drum 106. The paper stop rollers 112 feed a sheet of paper to the transfer position between the photoreceptor drum 106 and the transfer unit 110 in synchronism with the rotation of the drum 106. A fixing unit 113 is fitted on the conveying path F1 and positioned downstream from the photoreceptor drum 106. The charger 107 charges the circumferential surface of the photoreceptor drum 106 to a predetermined electric potential. Based on the image information input from the outside to the apparatus 100, the scanning unit 108 forms an electrostatic latent image on the drum surface.

The developing unit 109 holds two-component developer in it, which consists of carrier and toner. The developing unit 109 supplies the two-component developer to the circumferential surface of the photoreceptor drum 106 so as to visualize the latent image, forming a toner image on the drum surface. The developing unit 109 includes stirring blades 109A and a developing sleeve 109B in it. The stirring blades 109A stir and mix the carrier and the toner so as to charge the toner electrostatically. The charged toner sticks to the carrier.

The developing sleeve 109B takes the form of a roller and is fitted with a magnet in it. The developing sleeve 109B attracts magnetically to its circumferential surface the carrier to which the toner has stuck. The rotation of the developing sleeve 109B moves the carrier to a supply position adjacent to the photoreceptor drum 106. This causes the toner on the carrier to be attracted electrostatically to the latent image, so that the toner image is formed.

The developing unit 109 is fitted with a toner concentration sensor (not shown) in it, which senses the toner concentration in the two-component developer in this unit. When the toner concentration falls to a predetermined value, the developing unit 109 is supplied with toner from a toner supply unit 116.

The transfer unit 110 transfers to a sheet of paper passing along the conveying path F1 the toner image formed on the circumferential surface of the photoreceptor drum 106. The fixing unit 113 fixes the transferred toner image on the sheet, which is then discharged to the discharge tray 105. The cleaning unit 111 recovers the toner remaining on the circumferential surface of the photoreceptor drum 106 after the toner image is transferred to the sheet.

The apparatus 100 can form images on both sides of a sheet of paper by first forming an image on one side of the sheet, then turning over the sheet, returning the turned-over sheet along a reverse conveying path F2 to the transfer position, and forming an image on the other side of the returned sheet. An approximately horizontal conveying path F3 connects the feed cassette 104 to a point on the conveying path F1 that is upstream from the resist roller 112. The conveying path F3 leads to a manual feed tray 114 and an inlet port 115, which are fitted and formed respectively on one side of the apparatus 100. The feed tray 114 holds nonstandard-size sheets of paper. The inlet port 115 receives a sheet of paper from a large-capacity feeder (not shown), which may be fitted optionally to the apparatus 100. A sheet of paper fed from either the feed tray 114 or the inlet port 115 is conveyed along the conveying path F3 to the transfer position.

Another conveying path F4 connects the feed cassettes 102 and 103 to a point on the conveying path F1 that is upstream from the resist roller 112.

Conveying rollers 121-134, which are the conveying means, are supported on the conveying paths F1-F4. One drive motor (not shown) rotates the conveying rollers 121-134 to convey the sheets on the conveying paths F1-F4.

The apparatus 100 is fitted with a control unit 50 for controlling the operation of the whole apparatus. The control unit 50 controls the processing speed of the apparatus 100, as an example, by three steps. The processing speed is the number of sheets on which the apparatus 100 forms an image per unit time. The control unit 50 sets the processing speed for a high-speed print mode for the highest processing speed, a medium-speed print mode for higher image quality, or a low-speed print mode for thick paper or paper other than plain paper. The control unit 50 receives via an operating section (not shown) an input for selectively setting one of the three modes.

The processing speed depends on the circumferential velocity of the photoreceptor drum 106 etc. The circumferential velocity is 355 mm/s, 173 mm/s, and 124 mm/s in the high-speed, medium-speed, and low-speed print modes, respectively.

The control unit 50 drives the photoreceptor drum 106 at the circumferential velocity for the currently set mode and controls the driving of the conveying rollers 121-133, the stirring blades 109A, etc. according to this speed. In this embodiment, the single driving power source drives the conveying rollers 121-133 and the stirring blades 109A.

Figure 2:
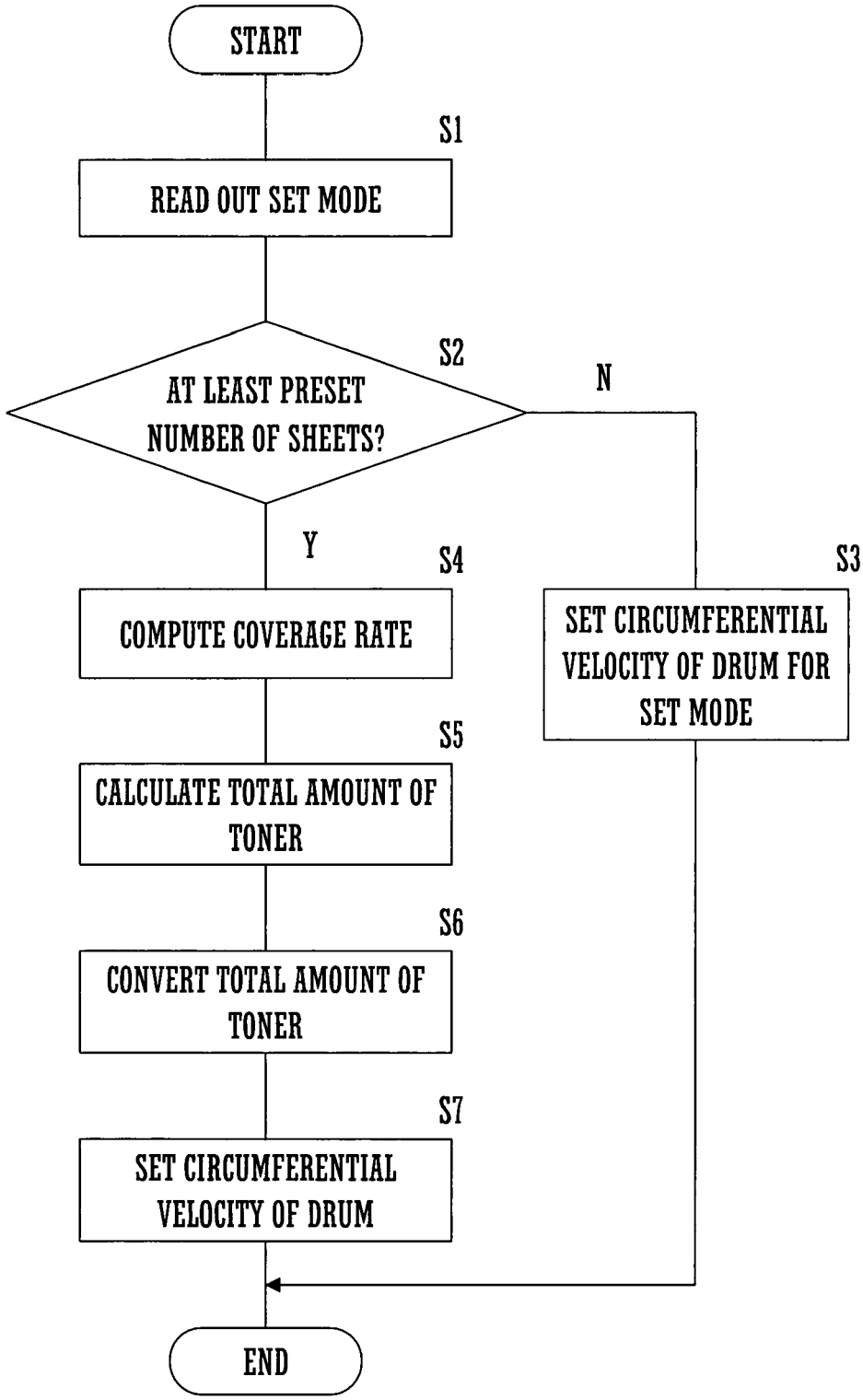
FIG. 2 is a flowchart of the procedure for changing the circumferential velocity of the photoreceptor drum of the apparatus in the first embodiment when the control unit of the apparatus receives a request to form an image or images.

FIG. 2 is a flowchart of the procedure for changing the circumferential velocity of the photoreceptor drum 106 when the control unit 50 receives a request to form an image or images. As stated already, the control unit 50 sets the processing speed in each mode. When the apparatus 100 forms an image consecutively on at least a predetermined number (100 in this embodiment) of sheets of paper or images each consecutively on at least the predetermined number of sheets, the control unit 50 changes the processing speed by changing the circumferential velocity of the photoreceptor drum 106 in inverse proportion to the coverage rates of images.

When the control unit 50 receives from the outside a request to form an image consecutively on a given number of sheets of paper or images each consecutively on the given number of sheets, this unit reads out the currently set mode from the memory 51 fitted in it (S1). Next, the control unit 50 determines whether the given number of sheets is at least the predetermined number (S2). If it is determined at step S2 that the given number of sheets is smaller than the predetermined number, the control unit 50 reads out the circumferential velocity of the photoreceptor drum 106 for the set mode from the memory 51 and sets this speed (S3). Then, the control unit 50 ends the procedure. Subsequently, the control unit 50 performs image formation at the set speed.

If it is determined at step S2 that the given number of sheets is at least the predetermined number, the control unit 50 computes the coverage rate of the image or each image by means of a known technique from the image information received by this unit with the request for image formation (S4). If the apparatus 100 is requested by the request to form two or more images, the control unit 50 computes the coverage rate of each image. Accordingly, the control unit 50 also corresponds to the coverage rate finding means.

Next, the control unit 50 finds the amount of toner necessary for each sheet from the coverage rate. Then, the control unit 50 calculates the total amount of toner necessary for the sheets on which the apparatus 100 is requested to form the image or images (S5). For example, the control unit 50 may read out from the memory 51 the amount of toner necessary for each sheet according to the size of the sheets and the coverage rate of the image or each image. If the apparatus 100 is requested by the request to form one image, the control unit 50 multiplies the amount of toner necessary for each sheet by the given number of sheets. If the apparatus 100 is requested by the request to form two or more images, the control unit 50 multiplies the amount of toner necessary for each sheet according to the coverage rate of each image by the given number of sheets. Then, the control unit 50 adds up the multiplied amounts of toner for all the images.

Next, the control unit 50 finds from the calculated total amount of toner the total amount of toner necessary for a unit number of sheets of paper of a standard size (S6). In this embodiment, the control unit 50 converts the total amount of toner found from the size and number of sheets on which the apparatus 100 is requested to form the image or images, and from the image information, into the reference amount of toner necessary for 100 sheets of paper of the standard size (for example, A4).

Next, based on the reference amount of toner and the currently set mode, the control unit 50 sets the optimum circumferential velocity of the photoreceptor drum 106 (S7). Then, the control unit 50 ends the procedure. Specifically, the control unit 50 determines in order of decreasing circumferential velocity from the set mode whether the reference amount of toner is not larger than the critical amount of toner supplied at the circumferential velocity of the photoreceptor drum 106 in each mode. Then, the control unit 50 sets the circumferential velocity at which the reference amount is not larger than the critical amount. Subsequently, the control unit 50 performs image formation at the set speed. Accordingly, the control unit 50 changes the circumferential velocity for each request for image formation. The control unit 50 also corresponds to the operation part.

The critical amount represents the amount of toner that the developing unit 109 can supply when the apparatus 100 forms an image on 100 sheets of paper of size A4 at the associated circumferential velocity of the photoreceptor drum 106. In this embodiment, the critical amounts of toner at the circumferential velocities of 355 mm/s, 173 mm/s, and 124 mm/s are 27 g, 37 g, and 42 g, respectively.

For example, if the high-speed print mode is set currently, and if the reference amount of toner is 24 g, this amount is smaller than the critical amount for this mode, so that the control unit 50 sets the circumferential velocity of the photoreceptor drum 106 at 355 mm/s for this mode.

If the high-speed print mode is set currently, and if the reference amount of toner is 39 g, this amount is larger than the critical amount for this mode. Then, the control unit 50 determines whether the reference amount is not larger than the critical amount for each of the medium-speed and low-speed print modes in order. Because the reference amount of 39 g is smaller than the critical amount in the low-speed print mode, the control unit 50 sets the circumferential velocity of the photoreceptor drum 106 at 124 mm/s for this mode even though the high-speed print mode is set currently.

In other words, as shown in FIG. 3, when the apparatus 100 forms an image or images consecutively on at least the predetermined number of sheets, the control unit 50 changes the circumferential velocity of the photoreceptor drum 106 (the processing speed) in inverse proportion to the coverage rate regardless of the circumferential velocity for the set mode. Accordingly, for a higher coverage rate, the control unit 50 lowers the circumferential velocity so as to lower the processing speed. As the circumferential velocity slows down, the intervals at which the sheets are conveyed consecutively become wider. This lowers the speed at which the sheets are conveyed and otherwise changes the control of parts of the apparatus 100. Accordingly, for a higher coverage rate, the developing unit 109 supplies a smaller amount of toner per unit time to the circumferential surface of the photoreceptor drum 106.

This lengthens the time taken after toner is supplied to the developing unit 109 and until toner is supplied to the circumferential surface of the photoreceptor drum 106. As a result, the toner and carrier are stirred for a longer time. Accordingly, even when the apparatus 100 forms an image with a high coverage rate or images with high coverage rates, for which it consumes a large amount of toner, consecutively on sheets of paper, sufficient toner and carrier stirring time is secured so that the toner supplied to the developing unit 109 can be charged to an amount of electrification necessary for development. This makes it possible to form the image or images on the sheets consecutively at high speed without lowering the quality of the image or images and interrupting the image forming operation in order to charge the toner.

It is essential that the predetermined number of sheets be two or more. It is preferable to predetermined, based on the relation between the coverage rates of images and the processing speed, the number of sheets that causes deterioration in image quality.

In this embodiment, the same driving power source drives the conveying rollers 121-133 and the stirring blades 109A. Accordingly, when the rotational speed of the conveying rollers 121-133 (conveying speed) slows down, the rotational speed of the stirring blades 109A (stirring speed) slows down. Toner has such a characteristic that, while it is stirred, its amount of electrification increases greatly at an initial stage and gradually thereafter. This characteristic prevents the amount of electrification of the toner in the developing unit 109 from decreasing by an amount equivalent to the decrease in the rotational speed of the stirring blades 109A. The widened intervals at which the sheets are consecutively conveyed make it possible to charge the toner to an amount of electrification sufficient for development, even though the same driving power source drives the conveying rollers 121-133 and the stirring blades 109A.

The conveying rollers 121-133 and the stirring blades 109A could be driven by different driving power sources. This would make it possible to maintain the stirring speed independently of the conveying speed by means of simple structures, so that the circumferential velocity of the photoreceptor drum 106 and the stirring speed could be controlled independently.

Specifically, even if the processing speed slows down due to its change based on a coverage rate, the stirring speed could be maintained, increased, or otherwise changed. This would, without making the processing speed too low, enable the toner supplied to the developing unit 109 to be charged to an amount of electrification necessary for development, so that the decrease in the processing speed could be suppressed.

Alternatively, the apparatus 100 might be fitted with means for changing the gear ratio between gears that transmit the driving force of the single driving power source to the stirring blades 109A. This would make it possible to independently control the circumferential velocity of the photoreceptor drum 106 and the stirring speed.

This embodiment has been described with reference to an apparatus for forming a monochromatic image. However, the present technology can also be applied to apparatus that can form color and monochromatic images. This technology may be applied to the latter apparatus both when the apparatus forms a color image and when it forms a monochromatic image. Alternatively, the technology may be applied to this apparatus only when the apparatus forms a monochromatic image, because, in general, the processing speed for a color image is lower than that for a monochromatic image. If the technology is applied to this apparatus only when the apparatus forms a monochromatic image, it is possible to prevent the apparatus from being complex in structure and control and suppress cost rises.

This embodiment has been described with reference to an apparatus for forming an image by using two-component developer, but the present technology can also be applied to apparatus for forming an image by using a one-component developer.

Second Embodiment

In this embodiment, when the apparatus 100 forms an image or images consecutively on at least a predetermined number of sheets of paper more than one, the control unit 50 changes only the stirring speed in proportion to the coverage rate of the image or each image. The stirring speed is the speed at which the toner and carrier in the developing unit 109 are stirred. The conveying rollers 121-133 and the stirring blades 109A are connected to different driving power sources (not shown). Otherwise, this embodiment is similar in structure to the first embodiment.

Figure 4:
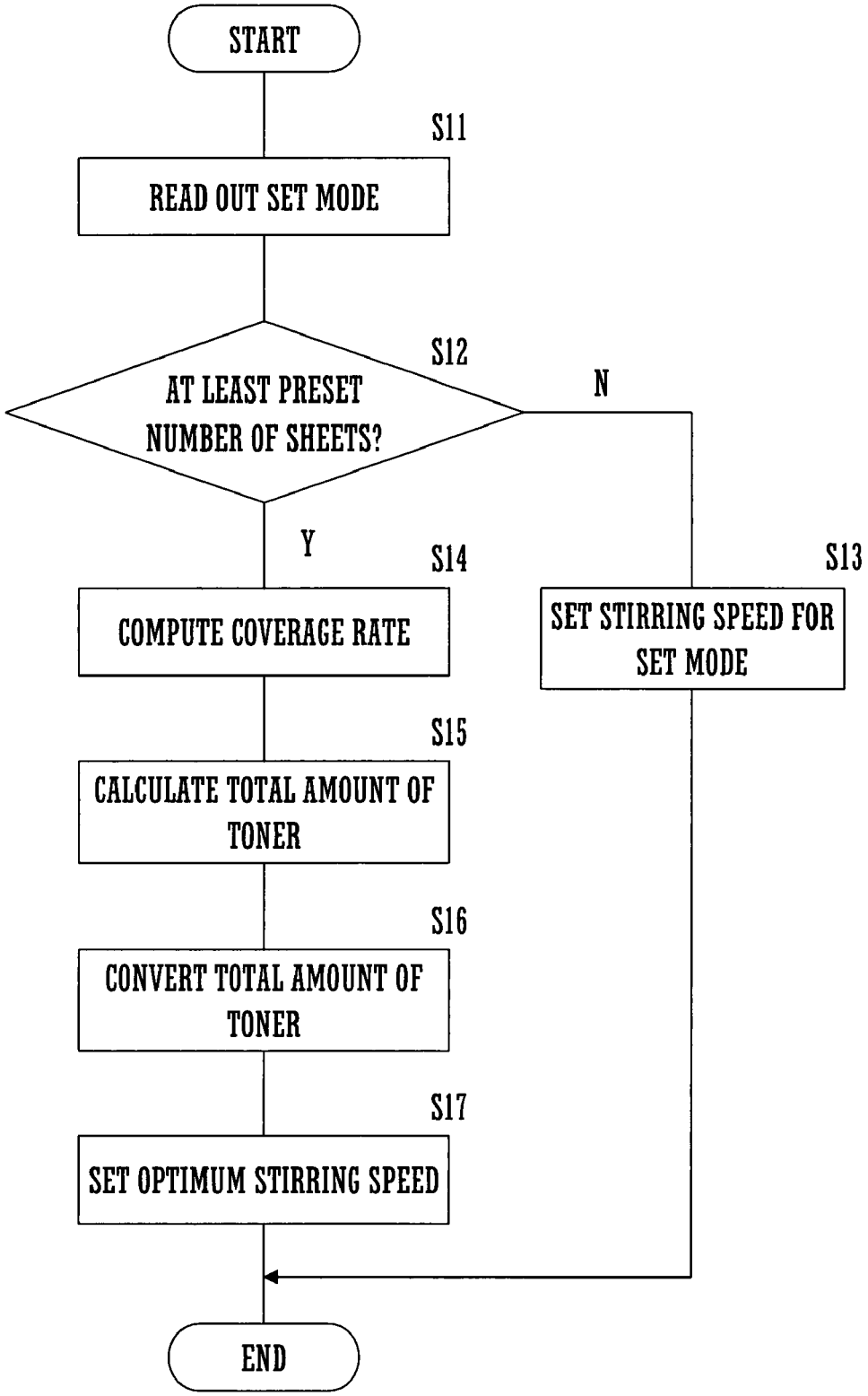
FIG. 4 is a flowchart of the procedure for changing the stirring speed in the second embodiment when the control unit receives a request to form an image or images.

FIG. 4 is a flowchart of the procedure for changing the stirring speed when the control unit 50 receives a request for image formation.

When the control unit 50 receives from the outside a request to form an image consecutively on a given number of sheets of paper or images each consecutively on the given number of sheets, this unit reads out the currently set mode from its memory 51 (S11), similarly to step S1 in FIG. 2. Next, the control unit 50 determines whether the given number of sheets is at least the predetermined number (S12), similarly to step S2 in FIG. 2. If it is determined at step S12 that the given number of sheets is smaller than the predetermined number, the control unit 50 reads out the stirring speed for the set mode from the memory 51 and sets the this speed (S13). Then, the control unit 50 ends the procedure. Subsequently, the control unit 50 performs image formation by activating the driving power source for the stirring blades 109A to rotate them at the set stirring speed.

If it is determined at step S12 that the given number of sheets is at least the predetermined number, the control unit 50 computes the coverage rate of the image or each image from the image information received by this unit with the request for image formation (S14), similarly to step S4 in FIG. 2. Next, the control unit 50 performs processing similar to steps S5 and S6 in FIG. 2 so as to convert the total amount of toner into the reference amount of toner necessary for a unit number (100) of sheets of paper of the standard size (A4) (S15 and S16).

Next, based on the reference amount of toner and the currently set mode, the control unit 50 sets the optimum stirring speed (S17). Then, the control unit 50 ends the procedure. For example, based on the relation between the stirring speed and the amount of toner necessary for each sheet that are stored in the memory 51, the control unit 50 may set the stirring speed for the reference amount of toner. In this embodiment, a higher stirring speed is associated with a higher coverage rate (a larger amount of toner for each sheet).

Subsequently, the control unit 50 performs image formation by activating the driving power source for the stirring blades 109A to rotate them at the set stirring speed. The control unit 50 changes the stirring speed for each request for image formation and sets the circumferential velocity of the photoreceptor drum 106 at the value for the set mode.

This makes it possible to rotate the stirring blades 109A at a higher stirring speed for a higher coverage rate when the apparatus 100 forms an image or images consecutively on at least the predetermined number of sheets. Accordingly, even when the apparatus 100 forms an image with a high coverage rate or images with high coverage rates, for which it consumes a large amount of toner, consecutively on sheets of paper, the toner and carrier stirring speed is high. Consequently, the toner supplied to the developing unit 109 can be charged quickly to an amount of electrification necessary for development. This makes it possible to achieve an effect similar to that achieved by the first embodiment.

It is essential that the predetermined number of sheets be two or more. It is preferable to predetermined, based on the relation between the coverage rates of images and the processing speed for the set mode, the number of sheets that causes deterioration in image quality.

In this embodiment, the different driving power sources drive the conveying rollers 121-133 and the stirring blades 109A. However, a single driving power source might drive the conveying rollers 121-133 and the stirring blades 109A if the conveying and stirring speeds could be controlled separately. For example, the apparatus 100 might be fitted with means for changing with the stirring speed the gear ratio between gears that transmit the driving force of the single driving power source to the stirring blades 109A.

This embodiment has been described with reference to an apparatus for forming a monochromatic image. However, as is the case with the first embodiment, the present technology can also be applied to apparatus that can form color and monochromatic images.

In this embodiment, as is the case with the first embodiment, the present technology can also be applied to apparatus for forming an image by using a one-component developer.

Third Embodiment

Figure 5:
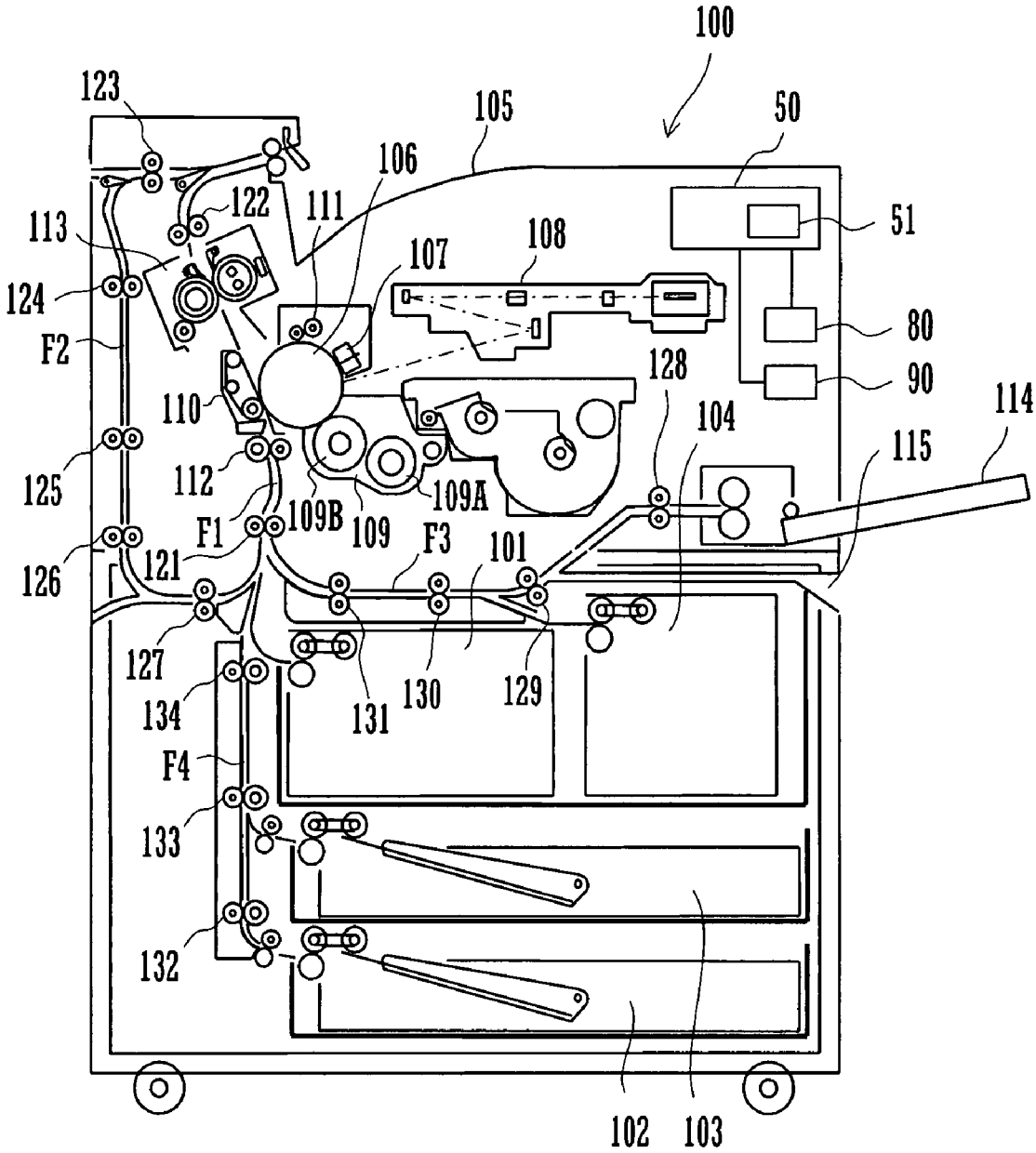
FIG. 5 is a schematic sectional view of an image forming apparatus according to a third embodiment.

FIG. 5 is a schematic sectional view of an image forming apparatus 100 according to a third embodiment. This apparatus 100 is fitted with a temperature sensor 80 and a humidity sensor 90 for sensing the temperature and humidity respectively in the apparatus, which are included in environmental conditions. The control unit 50 of the apparatus 100 changes the currently set processing speed based on the variation in the electrification characteristic of the toner under the environmental conditions and the coverage rate of an image. Otherwise, the apparatus 100 is similar in structure to that according to the first embodiment.

The sensors 80 and 90 sense the temperature and humidity respectively in the apparatus 100 and output the sensing results to the control unit 50. The sensors 80 and 90 correspond to the environment sensing means.

Figure 6:
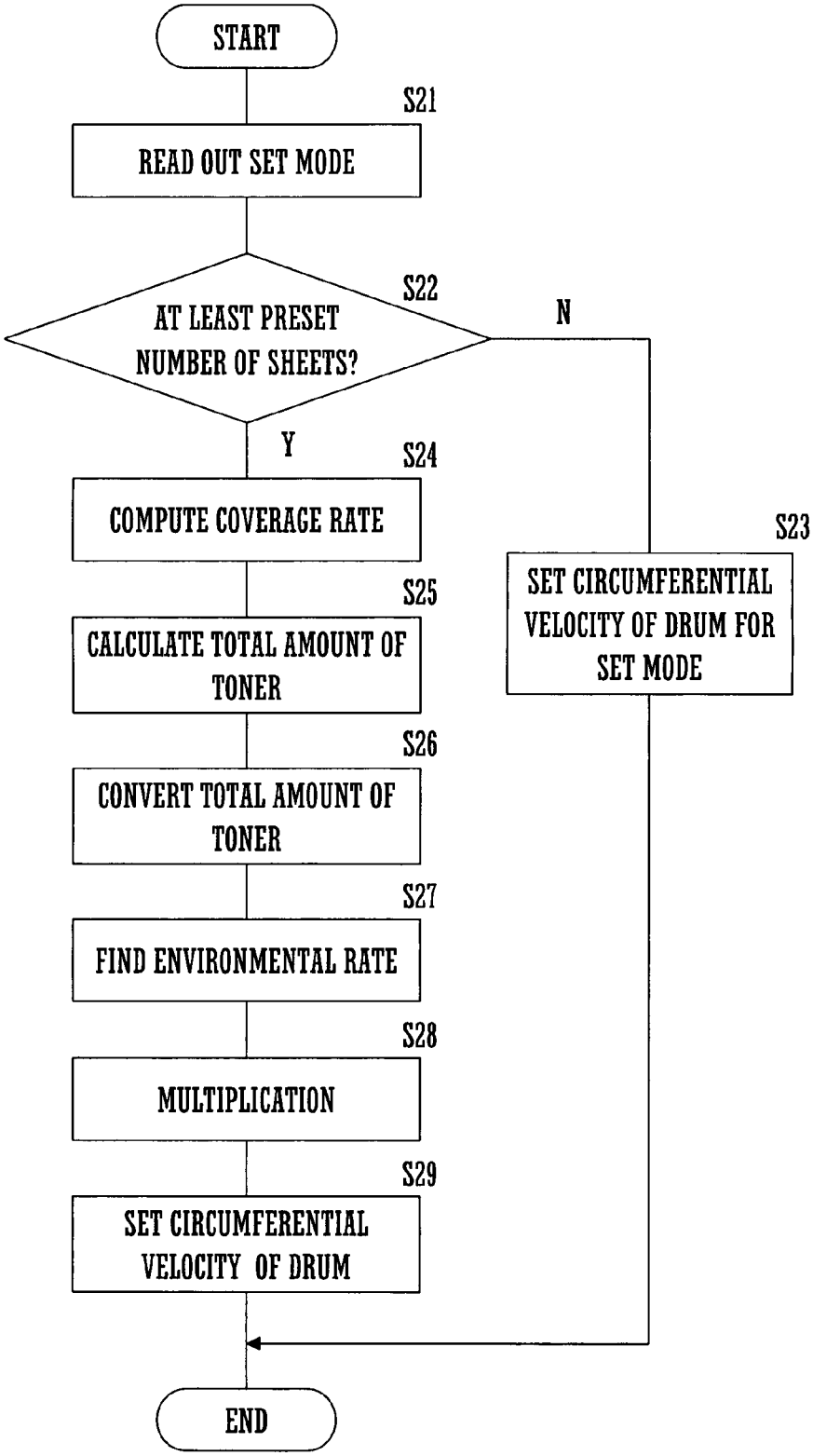
FIG. 6 is a flowchart of the procedure for changing the circumferential velocity of the photoreceptor drum of the apparatus in the third embodiment when the control unit of the apparatus receives a request to form an image or images.

FIG. 6 is a flowchart of the procedure for changing the circumferential velocity of the photoreceptor drum 106 of this apparatus 100 when the control unit 50 receives a request for image formation.

Steps S21-S26 are identical with steps S1-S6 respectively in FIG. 2 and will therefore not be described. After converting the total amount of toner into the reference amount of toner for 100 sheets of paper of size A4 at step S26, the control unit 50 finds an environmental ratio (S27), which is an electrification ratio that varies with the electrification performance of the toner under the environmental conditions. The control unit 50 sets the environmental ratio based on the electrification characteristic of the toner. Because the electrification characteristic of the toner varies with temperature and humidity as environmental conditions, the amount of toner necessary for each sheet varies apparently with them. As the temperature and humidity in the apparatus 100 rise, the toner in the developing unit 109 becomes more difficult to charge, and vice versa.

Accordingly, assuming that the environmental ratio is 1 at normal (room) temperature (25 degrees C.) and normal humidity (60%) as reference values, this ratio rises with temperature and humidity, and vice versa.

It is preferable to store in advance in a memory or the like the optimum environmental ratios calculated by experiment. In this embodiment, as shown in FIG. 7, the memory 51 stores the environmental ratio 1 at the normal temperature (N) of 25 degrees C. and the normal humidity (N) of 60%, the environmental ratio 1.24 at a high temperature (H) of 50 degrees C. and a high humidity (H) of 80%, and the environmental ratio 0.92 at a low temperature (L) of 10 degrees C. and a low humidity (L) of 30%.

The control unit 50 reads out from the memory 51 the environmental ratio associated with the temperature and humidity output from the sensors 80 and 90 at step S27, and this unit sets this ratio. If no environmental ratio is associated with the output temperature and humidity, the control unit 50 sets the environmental ratio associated with the normal temperature and humidity.

Subsequently, the control unit 50 multiplies the reference amount of toner by the set environmental ratio (S28). Next, based on the multiplied amount of toner and the currently set mode, the control unit 50 sets the optimum circumferential velocity of the photoreceptor drum 106, similarly to step S7 in FIG. 2. Then, the control unit 50 ends the procedure. Subsequently, the control unit 50 performs image formation at the set speed.

As a result, the circumferential velocity of the photoreceptor drum 106 is lower when the temperature and humidity in the apparatus 100 are high than when they are normal, and vice versa.

This makes it possible to achieve an effect similar to that achieved by the first embodiment and maintain suitable image quality regardless of variations in the environmental conditions.

In this embodiment, the control unit 50 changes the circumferential velocity of the photoreceptor drum 106 according to the coverage rate of an image and the variation in the electrification characteristic of the toner under the environmental conditions. A similar effect could be achieved if the variation in the electrification characteristic of the toner under the environmental conditions were taken into consideration when the control unit 50 changes the stirring speed according to the coverage rate, as is the case with the second embodiment.

For example, the control unit 50 might set the optimum stirring speed based on the currently set mode and the reference amount of toner multiplied by the set environmental ratio at step S28 in FIG. 6. The control unit 50 would make the stirring speed higher when the temperature and humidity in the apparatus 100 are high than when they are normal, and vice versa.

This embodiment has been described with reference to an apparatus for forming a monochromatic image. However, as is the case with the first embodiment, the present technology can also be applied to apparatus that can form color and monochromatic images.

In this embodiment, as is the case with the first embodiment, the present technology can also be applied to apparatus for forming an image by using a one-component developer.

The foregoing descriptions of the embodiments should be considered to be illustrative in all respects and nonrestrictive. The scope of the present technology is defined by the appended claims, not by the embodiments, and intended to include meanings equivalent to those in the claims and all modifications within the scope of the claims.

What is claimed is:

1. An apparatus for forming on at least one sheet of paper an image based on image information, the apparatus comprising:

a coverage rate finder for finding the coverage rate of the image;

an image carrier for carrying on a surface thereof a latent image based on the image information;

a developing unit adapted to hold developer therein;

the developing unit including a stirring means for stirring the held developer at a stirring speed;

the developing unit being also adapted to supply the stirred developer to the surface of the image carrier;

an environment sensing means for sensing an environmental condition including at least one of a temperature and a humidity in the apparatus; and a control unit for changing the stirring speed based on the coverage rate and the sensed environmental condition when the apparatus forms the image consecutively on a plurality of sheets of paper.

2. The apparatus according to claim 1, further comprising:

a conveying path and a conveying means for conveying the sheet or sheets along the conveying path;

the conveying and stirring means each including a driving power source.

3. An apparatus for forming on at least one sheet of paper an image based on image information, the apparatus comprising:

a coverage rate finder for finding the coverage rate of the image from the image information;

an image carrier for carrying on a surface thereof a latent image based on the image information;

a developing unit adapted to hold developer therein;

the developing unit including a stirring means for stirring the held developer at a stirring speed;

the developing unit being also adapted to supply the stirred developer to the surface of the image carrier; and a control unit for changing, in inverse proportion to the coverage rate, the number of sheets of paper on which the apparatus forms the image consecutively per unit time.

4. The apparatus according to claim 3, wherein, when the apparatus forms the image consecutively on a plurality of sheets of paper, the control unit independently controls the number of sheets on which the apparatus forms the image per unit time and the stirring speed.

5. The apparatus according to claim 4, further comprising:

a conveying path and a conveying means for conveying the sheet or sheets along the conveying path;

the conveying and stirring means each including a driving power source.

6. The apparatus according to claim 3, further comprising:

an environment sensing means for sensing environmental conditions including the temperature and humidity in the apparatus;

the control unit being adapted to further change, according to the variation in the electrification characteristic of the developer under the sensed environmental conditions, the number of sheets on which the apparatus forms the image consecutively per unit time.

7. The apparatus according to claim 1, wherein, every time the control unit receives a request to form an image consecutively on a plurality of sheets of paper, the control unit changes the stirring speed based on the coverage rate of the image and the sensed environmental condition.

8. The apparatus according to claim 3, wherein, every time the control unit receives a request to form an image consecutively on a plurality of sheets of paper, the control unit changes, in inverse proportion to the coverage rate of the image, the number of sheets on which the apparatus forms the image consecutively per unit time.

9. The apparatus according to claim 1, wherein the developing unit includes at least one developing device for monochromatic images, and wherein, only when the apparatus forms a monochromatic image consecutively on a plurality of sheets of paper, the control unit changes the stirring speed based on the coverage rate of the image and the sensed environmental condition.

10. The apparatus according to claim 3, wherein the developing unit includes at least one developing device for monochromatic images, and wherein, only when the apparatus forms a monochromatic image consecutively on a plurality of sheets of paper, the control unit changes, in inverse proportion to the coverage rate of the image, the number of sheets on which the apparatus forms the image per unit time.

11. A method for forming an image on at least one sheet of paper by forming on a surface of an image carrier a latent image based on image information, supplying the latent image with developer from a developing unit to form a developer image on the carrier surface, and transferring the developer image to the sheet, the developing unit including a stirring means for stirring the developer in the developing unit at a stirring speed, the method comprising the steps of:

finding the coverage rate of the image;

changing the stirring speed in proportion to the coverage rate when the apparatus forms the image consecutively on a plurality of sheets of paper;

detecting an environmental condition comprising at least one of temperature and humidity;

further changing the stirring speed based on a result of the detecting step; and driving the stirring means so that the stirring means can operate at the changed stirring speed.

12. A method for forming an image on at least one sheet of paper by forming on a surface of an image carrier a latent image based on image information, supplying the latent image with developer from a developing unit to form a developer image on the carrier surface, and transferring the developer image to the sheet, the method comprising the steps of:

finding the coverage rate of the image and changing, in inverse proportion to the coverage rate, the number of sheets on which the apparatus forms the image consecutively per unit time.

13. The method of claim 11, wherein the step of detecting an environmental condition comprises detecting both temperature and humidity.

14. The method of claim 12, further comprising a step of sensing an environmental condition including at least one of temperature and humidity in the apparatus, and wherein the changing step also comprises changing the number of sheets on which the apparatus forms the image consecutively per unit time based on the sensed environmental condition.

15. The method of claim 14, wherein the changing step comprises changing the number of sheets on which the apparatus forms the image consecutively per unit time based on a variation in the electrification characteristic of the developer under the sensed environmental condition.

16. The method of claim 14, wherein the sensing step comprises sensing both the temperature and the humidity in the apparatus.

* * * * *